United States Patent [19]

Igarashi et al.

[11] Patent Number: 4,628,335

[45] Date of Patent: Dec. 9, 1986

[54] HEAT-SENSITIVE RECORDING MATERIAL

[75] Inventors: Akira Igarashi; Kenji Ikeda; Kensuke Ikeda, all of Shizuoka, Japan

[73] Assignee: Fuji Photo Film Co., Ltd., Kanagawa, Japan

[21] Appl. No.: 781,575

[22] Filed: Sep. 30, 1985

[30] Foreign Application Priority Data

| | | | |
|---|---|---|---|
| Sep. 28, 1984 | [JP] | Japan | 59-203822 |
| Oct. 18, 1984 | [JP] | Japan | 59-219040 |
| Oct. 18, 1984 | [JP] | Japan | 59-219044 |
| Oct. 19, 1984 | [JP] | Japan | 59-220144 |
| Dec. 14, 1984 | [JP] | Japan | 59-264184 |

[51] Int. Cl.[4] ..... B41M 5/18

[52] U.S. Cl. ..... 346/208; 346/209; 346/216; 346/217; 346/221; 346/225; 427/150

[58] Field of Search ..... 346/208, 209, 216, 217, 346/221, 225, 150, 151, 152

[56] References Cited

FOREIGN PATENT DOCUMENTS 0101393 6/1984 Japan ..... 346/209

*Primary Examiner*—Bruce H. Hess

*Attorney, Agent, or Firm*—Sughrue, Mion, Zinn, Macpeak, and Seas

[57] ABSTRACT

A heat-sensitive recording material is described, comprising a heat-sensitive color forming layer containing a colorless or pale colored electron donating dye precursor and an electron accepting compound that reacts with said dye precursor to develop color, wherein said electron accepting compound is a bishydroxycumylbenzene or bishydroxy-α-methylbenzylbenzene compound.

11 Claims, No Drawings

HEAT-SENSITIVE RECORDING MATERIAL

FIELD OF THE INVENTION

The present invention relates to a heat-sensitive recording material, and more particularly, to a heat-sensitive recording material that depends for its operation on a color development reaction between a colorless or pale colored electron donating dye precursor and an electron accepting compound.

BACKGROUND OF THE INVENTION

Heat-sensitive recording materials that depend for their operation on a color development reaction between a colorless or pale colored electron donating dye precursor and an electron accepting compound are generally referred to as "two-component" color forming heat-sensitive recording materials, and examples of such recording materials are disclosed in Japanese Patent Publication Nos. 14039/70 and 4160/68 and Japanese Patent Application (OPI) No. 27253/80 (the term "OPI" as used herein refers to a "published unexamined Japanese patent application").

To make the "two-component" color forming heat-sensitive recording material, a dispersion of fine particles of a colorless or pale colored electron donating dye precursor and an electron accepting compound is mixed with the particles of a binder, etc., to form a coating solution which is applied to a support in such a manner that the two thermal reactive compounds remain separated from each other by the particles of binder, etc. The resulting coating forms an image by making use of a color forming reaction that is initiated by contact between the two compounds when one or both of them are melted with heat.

The "two-component" color forming heat-sensitive recording material has great practical value since it has the following advantages: (1) it depends on the primary color forming reaction and requires no subsequent development step; (2) the texture of the material is similar to that of ordinary paper; (3) it is easy to handle; (4) it provides high color density; and (5) heat-sensitive recording materials providing various colors can be easily prepared. Because of these advantages, the use of "two-component" color forming heat-sensitive recording materials is rapidly increasing in facsimiles, recording instruments and printers. As the use of facsimile equipment is rapidly expanding today, efforts are being made to achieve higher recording speeds, and this requires a corresponding improvement in the heat response of heat-sensitive recording materials intended for use with facsimiles, i.e., more efficient color formation in response to short heat pulses, or low thermal energies.

In order to make the most of the capability of modern heat-sensitive recording systems to operate at high speed, studies on color densities and sensitivities have been actively conducted. Two of the methods so far described to attain this object include using an oxybenzoic acid ester as an electron accepting compound as described in Japanese Patent Application (OPI) No. 144193/81, and using a salicylic acid ester as described in Japanese Patent Application (OPI) No. 201693/82. However, the combinations of electron donating colorless dyes (also referred to as a color former) and electron accepting compounds (also referred to as a color developer) that satisfy the requirement of high color density are generally ineffective in meeting the requirements of no fog and adequate resistance of colored paper to moisture and heat. Hence, the provision of an additional means for preventing the occurrence of fog or color fading has been desired.

As already mentioned, the "two-component" color forming heat-sensitive recording materials depend on the primary color forming reaction for their operation, but because of this very fact, the reaction between an electron donating dye precursor and an electron accepting compound takes place not only when heat is applied, but also when these materials are exposed to solvents. This results from the fact that all of the existing "two-component" color forming heat-sensitive recording materials are made of organics and their solubility in certain solvents is so great as to easily cause undesired reactions in such solvents. As a matter of fact, if the heat-sensitive recording materials are brought into contact with writing devices containing such solvents, such as pens using aqueous inks, pens using oily inks, and fluorescent pens, or diazo developers, or adhesives or glues, the white background of the heat-sensitive recording sheet develops color, or the printed characters fade or completely disappear, thus greatly reducing the commercial value of such recording sheets. Conventionally, this problem is avoided primarily by providing a solvent resistant protective layer on the heat-sensitive color forming layer, but this adds to the number of manufacturing steps, and hence, the cost.

Another problem with the heat-sensitive recording materials, especially heat-sensitive recording paper, is that the color of the image once formed will fade or disappear entirely because of the adverse effects of such external conditions as moisture and heat. This is indeed a serious problem for heat-sensitive recording materials, and various proposals have been made with a view to solving this problem. Japanese Patent Publication No. 43386/76 describes the addition of a phenolic derivative such as 4,4'-thiobis(6-tert-butyl-3-methylphenol); Japanese Patent Application (OPI) No. 17347/78 describes the addition of a modified, say, rosin modified, water-insoluble phenolic resin; and Japanese Patent Application (OPI) No. 72996/81 proposes the addition of a terephthalic acid ester such as dimethyl terephthalate. These methods are to some extent effective in preventing the fading of color images but, at the same time, they cause "fog", or unwanted color formation during the manufacture or storage of heat-sensitive recording material. This fog problem is highly sensitive to moisture and heat, so the commercial value of heat-sensitive recording materials treated by any one of the methods described above will be appreciably decreased under hot or humid conditions.

SUMMARY OF THE INVENTION

A principal object, therefore, of the present invention is to provide a heat-sensitive recording material that does not have a protective layer or any other extra coating on the heat-sensitive color forming layer, but which will neither form an undesired color nor undergo the fading of the intended color image upon contact with solvents or other chemicals, nor due to moisture and heat.

The stated object of the present invention can be accomplished by using a bishydroxycumylbenzene or bishydroxy-α-methylbenzylbenzene compound as an electron accepting compound in the heat-sensitive recording material.

DETAILED DESCRIPTION OF THE INVENTION

The electron accepting compounds preferred for use in the present invention are represented by formulae (I) to (IV)

(I)

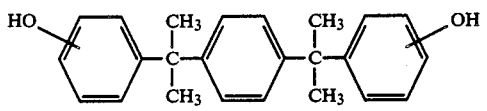

(II)

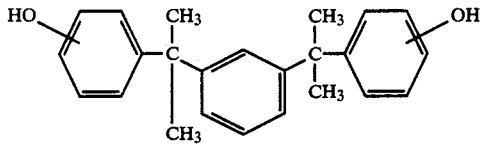

(III)

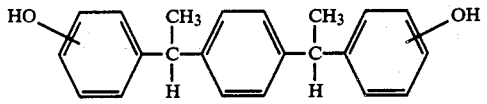

(IV)

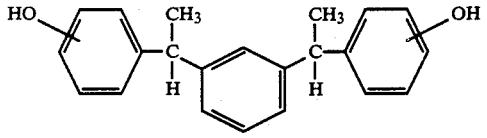

Illustrative examples of the compounds represented by these formulae are listed below:

(i) 1,4-bis-p-hydroxycumylbenzene,
(ii) 1,4-bis-m-hydroxycumylbenzene,
(iii) 1,3-bis-p-hydroxycumylbenzene,
(iv) 1,3-bis-m-hydroxycumylbenzene,
(v) 1,4-bis-o-hydroxycumylbenzene,
(vi) 1,4-bis-p-hydroxy-α-methylbenzylbenzene, and
(vii) 1,3-bis-p-hydroxy-α-methylbenzylbenzene.

Among these compounds, the compounds represented by formulae (I) and (II) are preferred, 1,3-bis-p-hydroxycumylbenzene and 1,4-bis-p-hydroxycumylbenzene are more preferred, and 1,4-bis-p-hydroxycumylbenzene is particularly preferred.

The electron accepting compound in accordance with the present invention, for example, 1,4-bis-p-hydroxycumylbenzene, can be prepared by subjecting diisopropenylbenzene to Friedel-Crafts reaction with 2 molar equivalents of phenol in the presence of an acid catalyst.

The color developer according to the present invention is preferably used in an amount of from 30 to 300 wt% based on the weight of the color former, more preferably 100 to 200 wt%.

Illustrative colorless or pale colored electron donating dye precursors suitable for use in the present invention include triarylmethane compounds, diphenylmethane compounds, xanthene compounds, thiazine compounds and spiropyran compounds, and specific examples of these compounds are described in Japanese Patent Application (OPI) No. 27253/80. Several of these examples are listed below: triarylmethane compounds such as 3,3-bis(p-dimethylaminophenyl)-6-dimethylaminophthalide (i.e., Crystal Violet Lactone), 3,3-bis(p-dimethylaminophenyl)phthalide, 3-(p-dimethylaminophenyl)-3-(1,3-dimethylindole-3-yl)phthalide, and 3-(p-dimethylaminophenyl)-3-(2-methylindole-3-yl)phthalide; diphenylmethane compounds such as 4,4'-bisdimethylaminobenzhydrin benzyl ether, N-halophenylleucoauramine and N-2,4,5-trichlorophenylleucoauramine; xanthene compounds such as rhodamine-B-anilinolactam, rhodamine(p-nitroanilino)lactam, rhodamine-B-(p-chloroanilino)lactam, 3-diethylamino-7-(dibenzylamino)fluoran, 3-diethylamino-7-phenylaminofluoran, 3-diethylamino-7-(o-chloroanilino)fluoran, 3-diethylamino-7-(3,4-dichloroanilino)fluoran, 3-piperidino-6-methyl-7-anilinofluoran and 3-diethylamino-7-phenylfluoran; thiazine compounds such as benzoylleucomethylene blue and p-nitrobenzylleucomethylene blue; spiro compounds such as 3-methyl-spiro-dinaphthopyran, 3-ethylspirodinaphthopyran, 3,3'-dichloro-spiro-dinaphthopyran, 3-benzyl-spiro-dinaphthopyran, 3-methyl-naphtho(3-methoxybenzo)-spiropyran and 3-propyl-spirodibenzopyran. These compounds are used either alone or in combination. Electron donating dye precursors comprised of triarylmethane compound (e.g., Crystal Violet Lactone) and xanthane compounds are preferred since most of them suffer low fog and produce high color densities. Particularly preferred are xanthane compounds represented by formula (V)

(V)

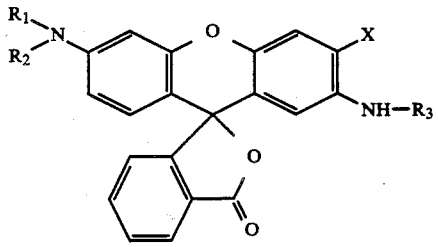

wherein $R_1$ and $R_2$ each represents an alkyl group or cycloalkyl group having from 1 to 10 carbon atoms; $R_3$ represents an aryl group; X represents an alkyl group having from 1 to 10 carbon atoms or a halogen atom.

The alkyl group denoted by $R_1$ and $R_2$ in formula (V) may be a straight chain or branched chain, and may even have a substituent. The aryl group denoted by $R_3$ preferably has from 6 to 20 carbon atoms, and a phenyl group and a substituted phenyl group are particularly preferred. Preferred substituents on the phenyl group are alkyl groups having from 1 to 10 carbon atoms.

Among the dye precursors represented by formula (V), particularly preferred compounds are those represented by formula (VI)

(VI)

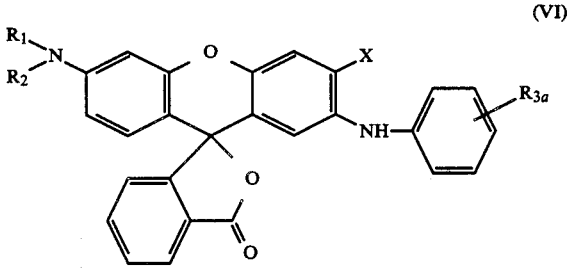

wherein $R_1$ and $R_2$ each represents an alkyl group having from 1 to 10 carbon atoms; $R_{3a}$ represents a hydrogen atom or an alkyl group having from 1 to 8 carbon atoms; and X represents an alkyl group having from 1 to 8 carbon atoms or a chlorine atom.

In formula (VI), the alkyl groups represented by $R_1$ and $R_2$ combine to form an aliphatic carbocyclic ring.

Particularly preferred compounds of formula (VI) are those wherein X is a methyl group or a chlorine atom.

Illustrative but in no way limiting examples of the colorless or pale colored electron donating dye precursors of formula (VI) include 3-dimethylamino-6-methyl-7-anilinofluoran, 3-N-methyl-N-ethylamino-6-methyl-7-anilinofluoran, 3-N-methyl-N-(isopropyl)amino-6-methyl-7-anilinofluoran, 3-N-methyl-N-pentylamino-6-methyl-7-anilinofluoran, 3-N-methyl-N-cyclohexylamino-6-methyl-7-anilinofluoran, 3-diethylamino-6-methyl-7-anilinofluoran, 3-dimethylamino-6-chloro-7-anilinofluoran, 3-N-ethyl-N-isoamyl-6-methyl-7-anilinofluoran, 3-N-methyl-N-isoamyl-6-methyl-7-anilinofluoran, 3-diethylamino-6-chloro-7-anilinofluoran, 3-N-methyl-N-ethylamino-6-chloro-7-anilinofluoran, 3-N-methyl-N-(isopropyl)amino-6-chloro-7-anilinofluoran, 3-N-methyl-N-pentylamino-6-chloro-7-anilinofluoran, 3-N-methyl-N-cyclohexylamino-6-chloro-7-anilinofluoran, 3-N-ethyl-N-pentylamino-6-methyl-7-anilinofluoran, 3-N-ethyl-N-pentylamino-6-chloro-7-anilinofluoran, 3-dimethylamino-6-methyl-7-(p-methylanilino)fluoran, 3-diethylamino-6-methyl-7-(p-methylanilino)fluoran, 3-N-methyl-N-ethylamino-6-methyl-7 -(p-methylanilino)fluoran, 3-N-methyl-N-(isopropyl)amino-6-methyl-7-(p-methylanilino)fluoran, 3-N-methyl-N-pentylamino-6-methyl-7-(p-methylanilino)fluoran, 3-N-methyl-N-cyclohexylamino-6-methyl-7-(p-methylanilino)fluoran, 3-N-ethyl-N-pentylamino-6-methyl-7-(p-methylanilino)fluoran, 3-dimethylamino-6-chloro-7-(p-methylanilino)fluoran, 3-diethylamino-6-chloro-7-(p-methylanilino)fluoran, 3-N-methyl-N-ethylamino-6-chloro-7-(p-methylanilino)fluoran, 3-N-methyl-N-(isopropyl-)amino-6-chloro-7-(p-methylanilino)fluoran, 3-N-methyl-N-cyclohexylamino-6-chloro-7-(p-methylanilino)-fluoran, 3-N-methyl-N-pentylamino-6-chloro-7-(p-methylanilino)fluoran, 3-N-ethyl-N-pentylamino-6-chloro-7-(p-methylanilino)fluoran, 3-N-methyl-N-furylmethyl-6-methyl-7-anilinofluoran and 3-N-ethyl-N-furylmethyl-6-methyl-7-anilinofluoran.

These compounds may be used alone, but for the purposes of tone adjustment and prevention of faded color images, they are preferably used in admixture.

The color former according to the present invention is preferably used in an amount of from 0.2 to 1.0 g/m$^2$, more preferably 0.3 to 0.6 g/m$^2$.

In order to have improved heat response, the heat-sensitive recording material of the present invention preferably has a heat-fusible substance in the heat-sensitive color forming layer.

Preferred examples of the heat-fusible substance are the compounds represented by the following formulae (VII) to (XII)

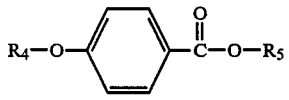
(VII)

-continued

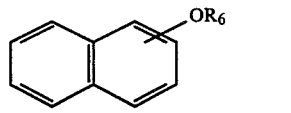
(VIII)

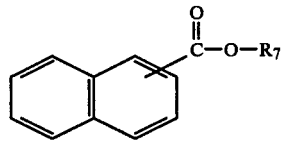
(IX)

$R_8NHCONH_2$ (X)

$R_9CONH—R_{10}$ (XI)

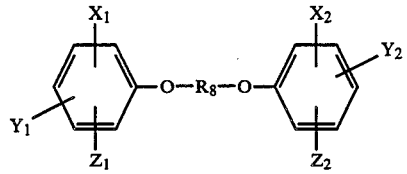
(XII)

wherein $R_4$, $R_5$, $R_6$ and $R_7$ each represents a phenyl group, a benzyl group, or a phenyl or benzyl group substituted by a lower alkyl group or a halogen atom; $R_8$ and $R_9$ each represents an alkyl group having from 12 to 24 carbon atoms; $R_{10}$ represents a hydrogen atom or a phenyl group; and $R_{11}$ represents a divalent group, preferably an alkylene group, an alkylene group having an ether linkage, an alkylene group having a carbonyl linkage, an alkylene group having a halogen atom, an alkylene group having an unsaturated bond, and more preferably an alkylene group or an alkylene group having an ether linkage; $X_1$, $Y_1$, $Z_1$, $X_2$, $Y_2$ and $Z_2$ (which may be the same or different) each represents a hydrogen atom, an alkyl group, a lower alkoxy group, a lower aralkyl group, a halogen atom, an alkyloxycarbonyl group, or an aralkyloxycarbonyl group.

If the phenyl or benzyl group represented by each of $R_4$ to $R_7$ in the formulae (VII) to (IX) is substituted by a lower alkyl group, such lower alkyl group has from 1 to 8 carbon atoms, and preferably from 1 to 3 carbon atoms. If a halogen atom is a substituent, chlorine or fluorine is preferred.

The compounds of formulae (VII) to (XII) preferably have melting points in the range of from 70° C. to 150° C. More preferably, they have melting points in the range of from 80° C. to 130° C.

More specific examples of the compounds of formulae (VII) to (XII) include the following: benzyl p-benzyloxybenzoate (m.p. 119° C.), β-naphtholbenzyl ether (m.p. 105° C.), stearic acid amide (m.p. 108° C.), palmitic acid amide (m.p. 103° C.), N-phenylstearic acid amide (m.p. 96° C.), phenyl ether of β-naphthoic acid (m.p. 92° C.), β-naphthol(p-chlorobenzyl)ether (m.p. 115° C.), β-naphthol(p-methylbenzyl)ether (m.p. 96° C.), α-naphtholbenzyl ether (m.p. 76° C.), 1,4-butanediol-p-methylphenyl ether (m.p. 104° C.), 1,4-propanediol-p-methylphenyl ether (m.p. 93° C.), 1,4-butanediol-p-isopropylphenyl ether (m.p. 79° C.), 1,4-butanediol-p-t-octylphenyl ether (m.p. 99° C.), and 2-phenoxy-1-p-tolyl-oxy-ethane (m.p. 104° C.).

The heat-fusible compounds of formulae (VII) to (XII) may be used either alone or in admixture. In order to ensure adequate heat response, the heat-fusible compounds are preferably used in amounts of from 10 to 200 wt%, and more preferably from 20 to 150 wt%, based on the weight of the electron accepting compound in accordance with the present invention.

The "two-component" heat-sensitive recording materials using an electron donating dye precursor and an electron accepting compound have a general tendency such that the color image once formed will fade as a result of the adverse effects of such external factors as moisture and heat.

In order to avoid such color fading and provide a color image that is resistant to ambient conditions, the heat-sensitive recording material in accordance with the present invention preferably incorporates an anti-fading compound in the heat-sensitive color forming layer.

Effective anti-fading agents are phenol derivatives, especially, hindered phenolic compounds. Preferred anti-fading agents are compounds represented by formulae (XIII) to (XVI)

(XIII)

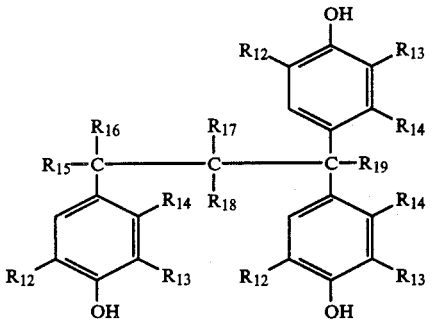

(XIV)

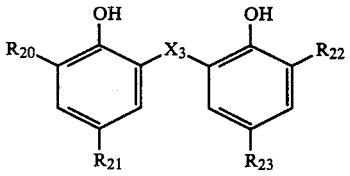

(XV)

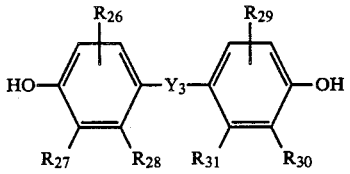

(XVI)

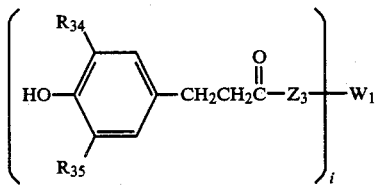

wherein $R_{12}$ represents a branched alkyl group having from 3 to 8 carbon atoms; $R_{13}$ is a hydrogen atom or a branched alkyl group having from 3 to 8 carbon atoms; $R_{14}$ represents a hydrogen atom or an alkyl group having from 1 to 3 carbon atoms; $R_{15}$ is a hydrogen atom or an alkyl group having from 1 to 8 carbon atoms; $R_{16}$, $R_{17}$, and $R_{18}$ each represents a hydrogen atom or an alkyl group having from 1 to 3 carbon atoms; $R_{19}$ represents a hydrogen atom or an alkyl group having from 1 to 8 carbon atoms;

$R_{20}$ and $R_{22}$ each represents a branched alkyl group having from 3 to 8 carbon atoms; $R_{21}$ and $R_{23}$ each represents an alkyl group having from 1 to 8 carbon atoms; $X_3$ represents S, O, $SO_2$, $S_2$,

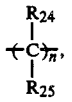

a cyclopentylene group or a cyclohexylene group, wherein n is an integer of 0 to 3, and $R_{24}$ and $R_{25}$ each represents an alkyl group having from 1 to 8 carbon atoms;

$R_{26}$ and $R_{29}$ each represents a branched alkyl group having from 3 to 8 carbon atoms; $R_{27}$, $R_{28}$, $R_{30}$, and $R_{31}$ each represents a hydrogen atom or an alkyl group having from 1 to 8 carbon atoms; $Y_3$ represents S, O, $SO_2$, $S_2$ or

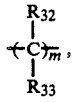

wherein m is an integer of 0 to 3, and $R_{32}$ and $R_{33}$ each represents a hydrogen atom or an alkyl group having from 1 to 8 carbon atoms, or $R_{32}$ and $R_{33}$ combine to form a cyclic pentamethylene group; and $R_{34}$ and $R_{35}$ each represents a branched alkyl group having from 3 to 8 carbon atoms; $Z_3$ represents —NH— or —$O(CH_2)_n$—, wherein n is an integer of 1 to 5; i is an integer of from 1 to 4, provided that if i=1, $W_1$ is an alkyl group having from 1 to 18 carbon atoms; if i=2, $W_1$ is S, O, or

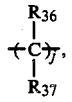

wherein $R_{36}$ and $R_{37}$ each represents a hydrogen atom or an alkyl group having from 1 to 8 carbon atoms; and j is an integer of 0 to 8; if i=3, $W_1$ is

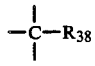

wherein $R_{38}$ is a hydrogen atom or an alkyl group having from 1 to 8 carbon atoms; and if i=4, $W_1$ is

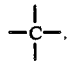

Typical examples of the phenolic derivatives represented by formulae (XIII) to (XVI) are listed below.

(A) phenolic compound of formula (XIII) such as 1,1,3-tris(2-methyl-4-hydroxy-5-tert-butylphenyl)butane, 1,1,3-tris(2-ethyl-4-hydroxy-5-tert-butylphenyl)butane, 1,1,3-tris(3,5-di-tert-butyl-4-hydroxyphenyl)butane and 1,1,3-tris(2-methyl-4-hydroxy-5-tert-butylphenyl)propane;

(B) phenolic compounds of formula (XIV) such as 2,2'-methylene-bis(6-tert-4-methylphenol), and 2,2'-methylene-bis(6-tert-butyl-4-ethylphenol);

(C) phenolic compounds of formula (XV) such as 4,4'-butylidene-bis(6-tert-butyl-3-methylphenol); and (D) phenolic compounds of formula (XVI) such as

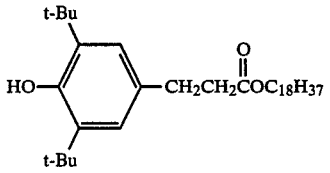

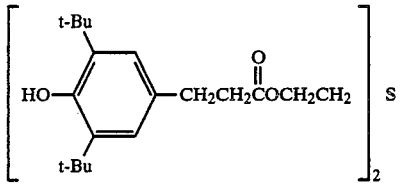

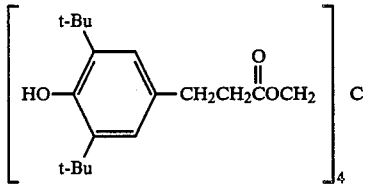

The phenolic compounds represented by formulae (XIII) to (XVI) are preferably used in amounts of from 5 to 200 wt%, and more preferably from 20 to 100 wt%, based on the weight of the electron accepting compound.

In order to prevent the fading of a desired color image and to avoid fogging of the background, electron accepting compounds are added which are represented by the formula (XVII) to (XXI)

(XVII)

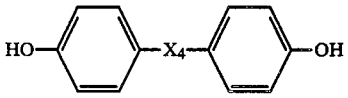

(XVIII)

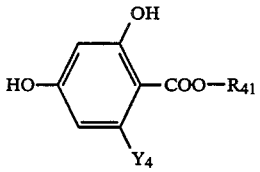

(XIX)

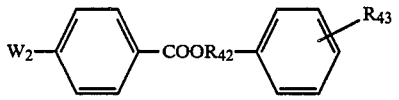

(XX)

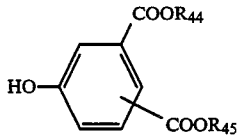

-continued (XIX)

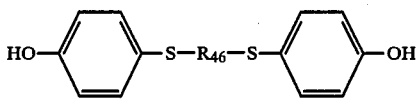

wherein $X_4$ represents S, O, $SO_2$, $S_2$, or

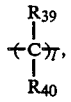

wherein l is an integer of 0 to 3; $R_{39}$ and $R_{40}$ each represents a hydrogen atom or an alkyl group having from 1 to 8 carbon atoms, or $R_{39}$ and $R_{40}$ combine to form a cycloalkyl group;

$Y_4$ represents a hydrogen atom, —$CH_3$ or —OH;

$R_{41}$ represents

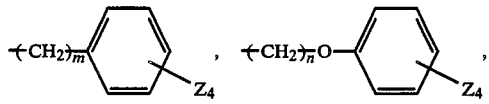

or a straight chain or branched chain alkyl group having from 1 to 6 carbon atoms, wherein m and n are each an integer of 0 to 3, and $Z_4$ represents a hydrogen atom, a halogen atom or —$CH_3$;

$W_2$ represents a hydrogen atom or —OH; $R_{42}$ represents a straight chain or branched chain alkylene group having from 1 to 8 carbon atoms; $R_{43}$ represents a hydrogen atom, a halogen atom or an alkyl group having from 1 to 8 carbon atoms;

$R_{44}$ and $R_{45}$ each represents an alkyl group having from 1 to 8 carbon atoms; and $R_{46}$ represents an alkylene group having from 1 to 5 ether linkages.

The compounds of formulae (XVII) to (XXI) are preferably used in amounts of from 5 to 200 wt%, and more preferably from 25 to 150 wt%, based on the weight of bishydroxycumylbenzene or bishydroxy-α-methylbenzylbenzene. Specific but non-limiting examples of the compounds of formulae (XVII) to (XX) include 1,1-bis(4-hydroxyphenyl)propane, 1,1-bis(4-hydroxyphenyl)butane, 1,1-bis(4-hydroxyphenyl)pentane, 2,2-bis(4-hydroxyphenyl)propane, 2,2-bis(4-hydroxyphenyl)butane, 2,2-bis(4-hydroxyphenyl)pentane, 1,1-bis(4-hydroxyphenyl)cyclohexane, 3,3-bis(4-hydroxyphenyl)pentane, 1,2-bis(4-hydroxyphenyl)ethane, 1,1-bis(4-hydroxyphenyl)sulfide, 1,1-bis(4-hydroxyphenyl)sulfone, 1,1-bis(4-hydroxyphenyl)ether, phenyl 2,4-dihydroxybenzoate, phenyl 2,4-dihydroxy-4'-methylbenzoate, phenyl 2,4-dihydroxy-4'-chlorobenzoate, phenyl 2,4-dihydroxy-6-methylbenzoate, phenyl 2,4,6-trihydroxybenzoate, phenyl 2,4-dihydroxy-6,4'-dimethylbenzoate, phenyl 2,4-dihydroxy-6-methyl-4'-chlorobenzoate, benzyl 2,4-dihydroxybenzoate, benzyl 2,4-dihydroxy-4'-methylbenzoate, benzyl 2,4-dihydroxy-4'-chlorobenzoate, benzyl 2,4-dihydroxy-6-methylbenzoate, benzyl 2,4,6-trihydroxybenzoate, benzyl 2,4-dihydroxy-6,4'-dimethylbenzoate, benzyl 2,4-dihydroxy-6-methyl-4'-chlorobenzoate, benzyl benzoate, benzyl 4-hydroxybenzoate, benzyl 4-hydroxy-4'-chlorobenzoate, benzyl 4-hydroxy-4'-methylbenzoate, benzyl 4-hydroxy-4'-ethylbenzoate, dimethyl 3-hydroxy-m-phthalate, diethyl 3-hydroxy-m-phthalate, methyl ethyl 3-hydroxy-m-phthalate, dibutyl 3-hydroxy-m-phthalate, dimethyl 3-hydroxy-o-phthalate, and diethyl 3-hydroxy-o-phthalate.

Specific examples of the compounds of formula (XXI) include

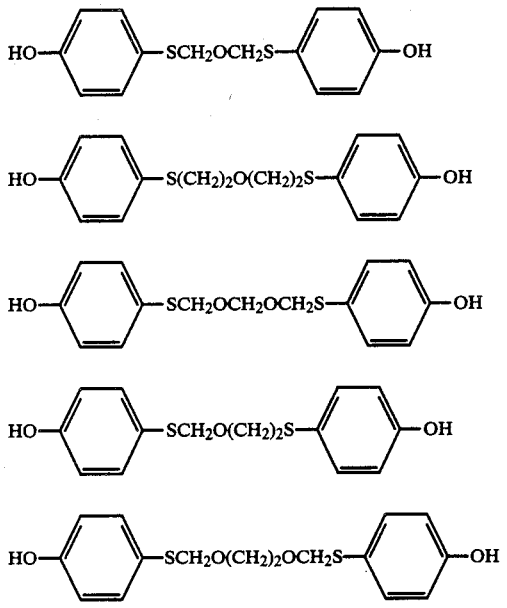

The recording layer of the heat-sensitive recording material in accordance with the present invention contains water-soluble binders and desirable binders are compounds that have solubilities of 5% or higher in water at 25° C. Illustrative binders that staisfy this requirement include methyl cellulose, carboxymethyl cellulose, hydroxyethyl cellulose, starches, gelatin, gum arabic, casein, hydrolyzed styrene-maleic anhydride copolymers, hydrolyzed ethylene-maleic anhydride copolymers, hydrolyzed isobutylene-maleic anhydride copolymers, polyvinyl alcohol, carboxy-modified polyvinyl alcohol and polyacrylamide.

In order to prepare a coating solution for heat-sensitive recording layer, the starting materials described above must be first dispersed in water. In this case, it is preferred to use water-soluble polymers such as polyvinyl alcohol, hydroxyethyl cellulose and starch derivatives. A dispersion medium, generally containing from 1 to 10 wt%, and preferably from 2 to 5 wt%, of a water-soluble polymer in water is first prepared. Then, to this dispersion medium, an electron donating dye precursor, electron acceptor, and/or other components are added in amounts ranging from 10 to 50 wt% of the medium, and the mixture is treated in a ball mill, sand mill, attritor or colloid mill, thereby obtaining desired dispersions.

These dispersions are then mixed together and, to the mixture, suitable additives such as oil absorbing pigments, other pigments, water-insoluble binders, waxes, metal soaps, and surfactants are added, so as to obtain a coating solution for heat-sensitive recording layer. This coating solution is applied to a suitable support made of, for example, paper or plastics, thereby providing the desired heat-sensitive recording material.

Illustrative oil absorbing pigments include kaolin, baked kaolin, talc, pyrophyllite, diatomaceous earth, calcium carbonate, aluminum hydroxide, magnesium hydroxide, magnesium carbonate, titanium oxide, barium carbonate, urea-formalin fillers and cellulose fillers.

Other suitable pigments include zinc oxide, barium sulfate, lithopone, talc, crystalline silica, and amorphous silica.

Commonly employed water-insoluble binders include synthetic rubber latexes and synthetic resin emulsions, such as styrene-butadiene rubber latex, acrylonitrile-butadiene rubber latex, methyl acrylatebutadiene rubber latex, and vinyl acetate emulsion.

Usable metal soaps include metal salts of higher aliphatic acids, and preferred examples are emulsions of zinc stearate, calcium stearate, aluminum stearate, and zinc oleate.

Suitable waxes include emulsions of paraffin wax, microcrystalline wax, carnauba wax, methylol stearoamide, polyethylene wax, and polystyrene wax, as well as higher aliphatic acid amides (e.g., stearylamide and ethylene bisstearoamide) and higher aliphatic acid esters.

Illustrative surfactants include alkali metal salts of sulfosuccinic acids and fluorine-containing surfactants.

The heat-sensitive recording material according to the present invention can be prepared in accordance with the conventional manners as described, for example, in U.S. Pat. Nos. 3,539,375 and 3,674,535.

The following examples are provided for further illustration of the claimed heat-sensitive recording material but are in no way construed as limiting.

EXAMPLE 1

Twenty grams of an electron donating dye precursor, viz., 3-diethylamino-6-chloro-7-anilinofluoran, was mixed with a 5% aqueous solution of polyvinyl alcohol (PVA-105 of Kuray Co., Ltd.) in a ball mill for 24 hours to prepare Dispersion A.

Sixty grams of 1,4-bis(p-hydroxycumyl)benzene was mixed with 300 g of a 5% aqueous polyvinyl alcohol solution for 24 hours to prepare Dispersion B.

Eighty grams of calcium carbonate (Brilliant-15 of Shiraishi Kogyo K.K.) was mixed with 80 g of a 1% solution of sodium hexametaphosphate in a homogenizer to prepare Dispersion C.

Dispersions A, B and C were mixed and combined with 60 g of a 30% dispersion of zinc stearate (Hydrin Z-7 of Chukyo Yushi K.K.) so as to form a coating solution for heat-sensitive recording layer. This solution was applied onto a base of fine paper (basis weight: 50 g/m$^2$) with a wire bar to form a coating having a dry weight of 4 g/m$^2$. The web was dried at 50° C. for 5 minutes and calendered to provide a surface smoothness of 500 seconds as determined by the Beck method.

EXAMPLE 2

Sixty grams of 1,4-bis(p-hydroxycumyl)benzene was dispersed in 60 g of a 5% aqueous polyvinyl alcohol solution together with 60 g of a heat-fusible material (i.e., stearic acid amide) by agitation for 24 hours. The resulting dispersion was designated as Dispersion D.

Calcium carbonate (140 g) was mixed with 140 g of 1% aqueous sodium hexametaphosphate solution in a homogenizer to prepare Dispersion E.

Dispersion A prepared in Example 1 was mixed with Dispersions D and E and combined with 60 g of a 30% dispersion of zinc stearate to form a coating solution for heat-sensitive recording layer. This solution was applied onto a base of fine paper (basis weight: 50 g/m$^2$) with a wire bar to form a coating having a dry weight of 6 g/m$^2$. The web was dried at 50° C. for 5 minutes and calendered to provide a surface smoothness of 500 seconds as determined by the Beck method.

EXAMPLES 3 TO 9

Heat-sensitive recording sheets were prepared as in Example 2, except that the heat-fusible compounds were changed to those indicated in Table 1.

EXAMPLE 10

A heat-sensitive recording sheet was prepared as in Example 2, except that the 3-diethylamino-6-chloro-7-anilinofluoran (electron donating dye precursor) was replaced by Crystal Violet Lactone.

EXAMPLE 11

Two electron donating dye precursors, 3-N-methyl-N-cyclohexylamino-6-methyl-7-anilinofluoran (10 g) and 3-diethylamino-6-chloro-7-anilinofluoran (10 g), were mixed with a 5% aqueous solution of polyvinyl alcohol in a ball mill for 24 hours so as to prepare Dispersion F.

Sixty grams of 1,4-bis(p-hydroxycumyl)benzene was dispersed in 600 g of 5% aqueous polyvinyl alcohol solution together with 60 g of 1,4-propanediol-p-methyl phenyl ether by agitation for 24 hours. The resulting dispersion was designated as Dispersion G.

Dispersion E prepared in Example 2 was mixed with Dispersions F and G and combined with 60 g of a 30% dispersion of zinc stearate to form a coating solution for heat-sensitive recording layer. This solution was applied onto a base of fine paper (basis weight: 50 g/m$^2$) with a wire bar to form a coating having a dry weight of 6 g/m$^2$. The web was dried at 50° C. for 5 minutes and calendered to provide a surface smoothness of 500 seconds as determined by the Beck method.

EXAMPLE 12

A heat-sensitive recording sheet was prepared as in Example 11 except that the 3-N-methyl-N-cyclohexylamino-6-methyl-7-anilinofluoran (electron donating dye precursor) was replaced by 3-N-ethyl-N-isoamyl-6-methyl-7-anilinofluoran.

EXAMPLE 13

Sixty grams of 1,4-bis(p-hydroxycumyl)benzene was dispersed in 600 g of a 5% aqueous solution of polyvinyl alcohol together with 60 g of 1,4-propanediol-p-methyl phenyl ether and 20 g of 1,1,3-tris(2-methyl-4-hydroxy-5-t-butylphenyl)butane by agitation in a ball mill for 24 hours. The resulting dispersion was designated as Dispersion H.

Dispersion F prepared in Example 11 was mixed with Dispersions E (Example 2) and H and combined with 60 g of a 30% dispersion of zinc stearate to form a coating solution for heat-sensitive recording layer. This solution was applied onto a base of fine paper (basis weight: 50 g/m$^2$) with a wire bar to form a coating having a dry weight of 6 g/m$^2$. The web was dried at 50° C. for 5 minutes and calendered to provide a surface smoothness of 500 seconds as determined by the Beck method.

COMPARATIVE EXAMPLES 1 TO 3

Heat-sensitive recording sheets were prepared as in Example 1, except that the 1,4-bis(p-hydroxycumyl)-benzene (electron accepting compound) was replaced by 2,2-bis(p-hydroxyphenyl)propane (Comp. Ex. 1), benzyl 4-hydroxybenzoate (Comp. Ex. 2), and 1,1-bis(4'-hydroxyphenyl)cyclohexane (Comp. Ex. 3).

COMPARATIVE EXAMPLES 4 TO 6

Heat-sensitive recording sheets were prepared as in Example 2, except that the 1,4-bis(p-hydroxycumyl)-benzene (electron accepting compound) was replaced by 2,2-bis(p-hydroxyphenyl)propane (Comp. Ex. 4), benzyl 4-hydroxybenzoate (Comp. Ex. 5), and 1,1-bis(4'-hydroxyphenyl)cyclohexane (Comp. Ex. 6).

COMPARATIVE EXAMPLES 7 TO 9

Heat-sensitive recording sheets were prepared as in Example 11, except that the 1,4-bis(p-hydroxycumyl)-benzene (electron accepting compound) was replaced by 2,2-bis(p-hydroxyphenyl)propane (Comp. Ex. 7), benzyl 4-hydroxybenzoate (Comp. Ex. 8), and 1,1-bis(4'-hydroxyphenyl)cyclohexane (Comp. Ex. 9).

COMPARATIVE EXAMPLES 10 TO 12

Heat-sensitive recording sheets were prepared as in Example 13, except that the 1,4-bis(p-hydroxycumyl)-benzene (electron accepting compound) was replaced by 2,2-bis(p-hydroxyphenyl)propane (Comp. Ex. 10), benzyl 4-hydroxybenzoate (Comp. Ex. 11), and 1,1-bis(4'-hydroxyphenyl)cyclohexane (Comp. Ex. 12).

The heat-sensitive recording sheets thus prepared were tested for their heat response characteristics by the following procedures: copies of Test Chart No. 3 (available from Gazo Denshi Gakkai, or The Institute of Image Electronics Engineers of Japan; CCITT No. 8 Test Chart) were taken on FF-2000 (high speed facsimile of Fujitsu Limited) and their densities were measured with a Macbeth densitometer, Model RD-918.

The heat-sensitive recording sheets were also tested for their resistance to solvents (or chemicals) by the following procedures: paper filters impregnated with ethanol, toluene and methyl cellosolve were superimposed on that side of a test sample where a color image was to be formed, and the degree of the resulting fog was evaluated on a three grade basis, viz., good, fair and poor.

Another set of test samples were touched by a thermal pen (120° C., 500 g/cm$^2$×5 sec) to form color and subsequently left to stand for 24 hours under two different conditions, 60° C. and 30% R.H. (for checking heat resistance) and 40° C. and 90% R.H. (for checking moisture resistance). The fog density and the color density of the area where a color image was formed were measured with a Macbeth densitometer, Model RD-918, before and after the storage. The percent residual density of the area with a color image was calculated by the following formula: (density after storage/density before storage)×100

The test results are shown in Table 1.

EXAMPLE 14

Two electron donating dye precursors, i.e., 10 g of 3-diethylamino-6-chloro-7-anilinofluoran and 10 g of 3-N-methyl-N-cyclohexyl-6-methyl-7-anilinofluoran, were mixed with 100 g of a 5% aqueous solution of polyvinyl alcohol (PVA 105 of Kuray Co., Ltd.) in a ball mill for 24 hours to prepare Dispersion I.

Sixty grams of 1,4-bis(p-hydroxycumyl)benzene and an equal amount of 2,2-bis(4-hydroxyphenyl)propane were mixed with 600 g of 5% aqueous polyvinyl alcohol solution for 24 hours to prepare Dispersion J.

A hundred grams of calcium carbonate (Brilliant 15 of Mizusawa Chemical Industries Ltd.) was mixed with 100 g of a 1% solution of sodium hexametaphosphate in a homogenizer to prepare Dispersion K.

Dispersions I, J, and K were mixed and combined with 60 g of a 30% dispersion of zinc stearate (Hydrin Z-7 of Chukyo Yushi K.K.) so as to form a coating solution for heat-sensitive recording layer. This solution was applied to a base of fine paper (basis weight: 50 g/m$^2$) with a wire bar to form a coating having a dry weight of 5 g/m$^2$. The web was dried for 5 minutes and calendered to provide a heat-sensitive recording sheet.

EXAMPLE 15

A heat-sensitive recording sheet was prepared as in Example 14, except that 2,2-bis(4-hydroxyphenyl)propane was replaced by benzyl 4-hydroxybenzoate.

EXAMPLE 16

A heat-sensitive recording sheet was prepared as in Example 14, except that 2,2-bis(4-hydroxyphenyl)propane was replaced by benzyl 2,4-dioxybenzoate.

EXAMPLE 17

A heat-sensitive recording sheet was prepared as in Example 14, except that 2,2-bis(4-hydroxyphenyl)propane was replaced by benzyl 4-hydroxy-4'-chlorobenzoate.

EXAMPLE 18

A heat-sensitive recording sheet was prepared as in Example 14, except that 2,2-bis(p-hydroxyphenyl)propane was replaced by methylhydroxyisophthalate.

EXAMPLE 19

A heat-sensitive recording sheet was prepared as in Example 14, except that 2,2-bis(p-hydroxyphenyl)propane was replaced by 1,3-di(4-hydroxyphenylthio)-2-oxa-propane.

EXAMPLE 20

A heat-sensitive recording sheet was prepared as in Example 14, except that 2,2-bis(p-hydroxyphenyl)propane was replaced by 1,1-bis(p-hydroxyphenyl)cyclohexane.

EXAMPLE 21

Thirty grams of 1,4-bis(p-hydroxycumyl)benzene and 30 g of 1,1-bis(p-hydroxyphenyl)cyclohexane were dispersed in 600 g of 5% aqueous polyvinyl alcohol solution together with 60 g of stearic acid amide by agitation in a ball mill for 24 hours to prepare Dispersion L.

Dispersion F prepared in Example 11 was mixed with Dispersions E (Example 2) and L and combined with 60 g of a 30% dispersion of zinc stearate to form a coating solution for heat-sensitive recording layer. This solution was applied onto a base of fine paper (basis weight: 50 g/m$^2$) with a wire bar to form a coating having a dry weight of 6 g/m$^2$. The web was dried at 50° C. for 5 minutes and calendered to provide a surface smoothness of 500 seconds as determined by the Beck method.

COMPARATIVE EXAMPLE 13

A heat-sensitive recording sheet was prepared as in Example 1, except that the mixture of 1,4-bis(p-hydroxycumyl)benzene and 2,2-bis(p-hydroxyphenyl)propane was replaced by 1,1-bis(4-hydroxyphenyl)cyclohexane.

COMPARATIVE EXAMPLE 14

A heat-sensitive recording sheet was prepared as in Example 1, except that no 1,4-bis(p-hydroxycumyl)benzene was used.

COMPARATIVE TESTS

The heat-sensitive recording sheets prepared in Examples 14 to 21 and those prepared in Comparative Examples 13 and 14 were subjected to the following tests in order to compare their capabilities.

(1) Fog and Color Forming Ability:

Heat-sensitive recording was performed by applying a thermal energy of 16 mJ/m$^2$ to the recording element for 5 ms per dot (dot density: 8 dots/mm for main scanning, and 9 dots/mm for sub-scanning). The density of fog (the density of the background before recording) and the initial density of the colored area just after recording were measured with a Macbeth reflection densitometer, Model RD-918, using a visual filter.

(2) Moisture Resistance:

The heat-sensitive recording sheets that had produced a color image in the previous test were left to stand for 24 hours at 40° C. and 90% R.H., and the fog density (the density of the background) and that of the colored area were measured. The percent residual density of the colored area was calculated by the following formula:

$$\frac{\text{Density after standing at 40° C.} \times \text{90\% R.H.}}{\text{Initial density}} \times 100(\%)$$

(3) Heat Resistance:

The heat-sensitive recording sheets that had produced a color image in test (1) were left to stand for 24 hours at 60° C. and 30% R.H., and the fog density (the density of the background) and that of the colored area were measured. The percent residual density of the colored area was calculated by the following formula:

$$\frac{\text{Density after standing at 60° C.} \times \text{30\% R.H.}}{\text{Initial density}} \times 100(\%)$$

(4) Resistance to Solvents:

The procedures for solvent resistance test were the same as those used in the testing of the samples prepared in Examples 1 to 13 and Comparative Examples 1 to 12.

The test results are shown in Table 2.

TABLE 1

| Ex. No. | Electron Accepting Compound | Heat-Fusible Compound | Solvent Resistance: Color Density | Solvent Resistance: Ethanol | Solvent Resistance: Toluene | Solvent Resistance: Methyl Cellosolve | Heat Resistance: Fog | Heat Resistance: Residual Density (%) | Moisture Resistance: Fog | Moisture Resistance: Residual Density % |
|---|---|---|---|---|---|---|---|---|---|---|
| Ex. 1 | 1,4-Bis(p-hydroxycumyl)-benzene | None | 0.70 | o | o | o | 0.07 | 72 | 0.07 | 78 |

TABLE 1-continued

| Ex. No. | Electron Accepting Compound | Heat-Fusible Compound | Solvent Resistance: Color Density | Solvent Resistance: Ethanol | Solvent Resistance: Toluene | Solvent Resistance: Methyl Cellosolve | Heat Resistance: Fog | Heat Resistance: Residual Density (%) | Moisture Resistance: Fog | Moisture Resistance: Residual Density % |
|---|---|---|---|---|---|---|---|---|---|---|
| Ex. 2 | 1,4-Bis(p-hydroxycumyl)-benzene | Stearylamide | 1.12 | o | o | o | 0.09 | 81 | 0.09 | 86 |
| Ex. 3 | 1,4-Bis(p-hydroxycumyl)-benzene | Benzyl p-benzyloxy-benzoate | 1.20 | o | o | o | 0.08 | 80 | 0.08 | 83 |
| Ex. 4 | 1,4-Bis(p-hydroxycumyl)-benzene | β-Naphthol-benzyl ether | 1.30 | o | o | o | 0.07 | 83 | 0.07 | 85 |
| Ex. 5 | 1,4-Bis(p-hydroxycumyl)-benzene | Phenyl β-naphthoate | 1.22 | o | o | o | 0.07 | 85 | 0.07 | 86 |
| Ex. 6 | 1,4-Bis(p-hydroxycumyl)-benzene | N—phenyl-stearylamide | 1.19 | o | o | o | 0.07 | 82 | 0.07 | 84 |
| Ex. 7 | 1,4-Bis(p-hydroxycumyl)-benzene | α-Naphthol-benzyl ether | 1.28 | o | o | o | 0.08 | 80 | 0.07 | 83 |
| Ex. 8 | 1,4-Bis(p-hydroxycumyl)-benzene | 1,4-Propane-diol-p-methyl-phenyl ester | 1.35 | o | o | o | 0.07 | 80 | 0.07 | 85 |
| Ex. 9 | 1,4-Bis(p-hydroxycumyl)-benzene | 1,4-Butane-diol-p-methyl-phenyl ester | 1.35 | o | o | o | 0.07 | 83 | 0.07 | 84 |
| Ex. 10 | 1,4-Bis(p-hydroxycumyl)-benzene | Stearylamide | 1.10 | o | o | o | 0.09 | 80 | 0.07 | 78 |
| Ex. 11 | 1,4-Bis(p-hydroxycumyl)-benzene | 1,4-Propane-diol-p-methyl-phenyl ester | 1.35 | o | o | o | 0.07 | 90 | 0.07 | 90 |
| Ex. 12 | 1,4-Bis(p-hydroxycumyl)-benzene | 1,4-Propane-diol-p-methyl-phenyl ester | 1.35 | o | o | o | 0.07 | 88 | 0.07 | 92 |
| Ex. 13 | 1,4-Bis(p-hydroxycumyl)-benzene | 1,4-Propane-diol-p-methyl-phenyl ester | 1.35 | o | o | o | 0.07 | 99 | 0.07 | 98 |
| Comp. Ex. 1 | 2,2-bis(p-hydroxyphenyl)-propane | None | 0.70 | x | x | x | 0.07 | 50 | 0.07 | 62 |
| Comp. Ex. 2 | Benzyl 4-hydroxybenzoate | None | 1.10 | Δ | Δ | Δ | 0.07 | 28 | 0.07 | 22 |
| Comp. Ex. 3 | 1,1-Bis(4'-hydroxyphenyl)-cyclohexane | None | 0.65 | Δ | Δ | Δ | 0.07 | 35 | 0.07 | 42 |
| Comp. Ex. 4 | 2,2-Bis(p-hydroxyphenyl)-propane | Stearylamide | 1.13 | x | x | x | 0.12 | 52 | 0.10 | 63 |
| Comp. Ex. 5 | Benzyl 4-hydroxybenzoate | Stearylamide | 1.23 | Δ | Δ | Δ | 0.21 | 43 | 0.08 | 39 |
| Comp. Ex. 6 | 1,1-bis(4'-hydroxyphenyl)-cyclohexane | Stearylamide | 1.05 | Δ | Δ | Δ | 0.13 | 38 | 0.10 | 40 |
| Comp. Ex. 7 | 2,2-Bis(p-hydroxyphenyl-propane | 4,4-Propane-diol-p-methyl-phenyl ester | 1.28 | x | x | x | 0.07 | 90 | 0.08 | 95 |
| Comp. Ex. 8 | Benzyl 4-hydroxybenzoate | 4,4-Propane-diol-p-methyl-phenyl ester | 1.35 | Δ | Δ | x | 0.10 | 78 | 0.09 | 82 |
| Comp. Ex. 9 | 1,1-Bis(4'-hydroxyphenyl)-cyclohexane | 4,4-Propane-diol-p-methyl-phenyl ester | 1.20 | Δ | Δ | Δ | 0.07 | 82 | 0.07 | 85 |
| Comp. Ex. 10 | 2,2-Bis(p-hydroxyphenyl)-propane | 4,4-Propane-diol-p-methyl-phenyl ester | 1.25 | x | x | x | 0.07 | 95 | 0.07 | 97 |
| Comp. Ex. 11 | Benzyl 4-hydroxybenzoate | 4,4-Propane-diol-p-methyl-phenyl ester | 1.32 | Δ | x | x | 0.13 | 88 | 0.12 | 87 |
| Comp. Ex. 12 | 1,1-Bis(4'-hydroxyphenyl)-cyclohexane | 4,4-Propane-diol-p-methyl-phenyl ester | 1.25 | Δ | x | x | 0.18 | 90 | 0.07 | 93 |

o: good, Δ: fair, x: poor

TABLE 2

| Ex. No. | Initial Properties Density | Initial Properties Fog | Moisture Resistance Residual Density (%) | Moisture Resistance Fog | Heat Resistance Residual Density (%) | Heat Resistance Fog | Solvent Resistance Ethanol | Solvent Resistance Toluene | Solvent Resistance Methyl Cellosolve |
|---|---|---|---|---|---|---|---|---|---|
| Example 14 | 1.22 | 0.08 | 95 | 0.06 | 95 | 0.05 | o | Δ | o |
| Example 15 | 1.20 | 0.07 | 100 | 0.06 | 95 | 0.05 | o | o | o |
| Example 16 | 1.20 | 0.07 | 100 | 0.06 | 100 | 0.06 | o | o | o |
| Example 17 | 1.22 | 0.07 | 95 | 0.06 | 100 | 0.06 | o | o | o |
| Example 18 | 1.20 | 0.07 | 98 | 0.06 | 95 | 0.05 | o | o | o |
| Example 19 | 1.20 | 0.08 | 100 | 0.06 | 95 | 0.06 | o | o | o |
| Example 20 | 1.22 | 0.07 | 100 | 0.07 | 98 | 0.08 | o | o | o |
| Example 21 | 1.30 | 0.08 | 98 | 0.08 | 98 | 0.08 | o | o | o |
| Comparative Example 13 | 1.00 | 0.08 | 80 | 0.10 | 70 | 0.12 | Δ | Δ | x |
| Comparative Example 14 | 1.05 | 0.10 | 85 | 0.14 | 80 | 0.20 | x | x | x |

o: good, Δ: fair, x: poor

EXAMPLE 22

Twenty grams of 3-(N-cyclohexyl-N-methyl)amino-6-methyl-7-anilinofluoran was mixed with 100 g of a 5% aqueous solution of polyvinyl alcohol (degree of saponification: 98%, degree of polymerization: 500) for 24 hours in a 300 ml ball mill so as to prepare Dispersion M.

In a similar manner, 20 g of 1,4-bis(p-hydroxycumyl)-benzene was mixed with 100 g of 5% polyvinyl alcohol for 24 hours in a 300 ml ball mill so as to prepare Dispersion N.

Dispersions M and N were mixed in a weight ratio of 5/10, and to 300 g of the mixture, 100 g of a 40% dispersion of calcium carbonate and 45 g of a 21% dispersion of zinc stearate were added, followed by thorough agitation to prepare a coating solution for heat-sensitive recording layer.

This solution was applied to a base paper (basis weight: 50 g/m$^2$) with a wire bar to form a coating having a dry weight of 6 g/m$^2$. The web was then dried to provide a sample of heat-sensitive recording material of the present invention.

EXAMPLE 23

A sample of heat-sensitive recording paper was obtained as in Example 22, except that Dispersion M was prepared by replacing 3-(N-cyclohexyl-N-methyl-)amino-6-methyl-7-anilinofluoran with 20 g of 3-(N-ethyl-N-tetrahydrofurfuryl)amino-6-methyl-7-anilinofluoran.

COMPARATIVE EXAMPLE 15

A sample of heat-sensitive recording paper was obtained as in Example 22, except that Dispersion N was prepared by replacing 1,4-bis(p-hydroxycumyl)benzene with 20 g of 2,2-bis(p-hydroxyphenyl)propane.

COMPARATIVE EXAMPLE 16

A sample of heat-sensitive recording paper was obtained as in Example 22, except that Dispersion M was prepared by replacing 3-(N-cyclohexyl-N-methyl-)amino-6-methyl-7-anilinofluoran with 20 g of 3-N,N-diethylamino-7-(o-chloro)anilinofluoran, and that Dispersion N was prepared by replacing 1,4-bix(p-hydroxycumyl)benzene with benzyl p-hydroxybenzoate.

COMPARATIVE TESTS

The samples of heat-sensitive recording paper prepared in Examples 22 and 23 and those prepared in Comparative Examples 15 and 16 were subjected to the following tests in order to compare their capabilities.

(1) Fog and Color Forming Ability:
Same as described above.

(2) Moisture Resistance:
Same as described above.

(3) Heat Resistance:
Same as described above.

(4) Resistance to Chemicals:
The chemical resistance of each of the samples was tested with two fluorescent pens (Fluorescent pen 2 of Zebra K.K. and Fluorescent Spot Writer of The Pilot Pen Co., Ltd.), a felt pen, and ethanol.

The results of tests (1) to (4) are summarized in Table 3.

TABLE 3

| Ex. No. | Density | Fog | Moisture Resistance Residual Density (%) | Moisture Resistance Fog | Heat Resistance Residual Density (%) | Heat Resistance Fog | Chemical Resistance Zebra | Chemical Resistance Pilot | Chemical Resistance Felt Pen | Chemical Resistance Ethanol |
|---|---|---|---|---|---|---|---|---|---|---|
| Example 22 | 1.10 | 0.07 | 100 | 0.08 | 93 | 0.07 | o | o | o | o |
| Example 23 | 1.10 | 0.07 | 100 | 0.08 | 95 | 0.07 | o | o | o | o |
| Comparative Example 15 | 0.80 | 0.08 | 70 | 0.10 | 60 | 0.30 | o | o | o | o |
| Comparative Example 16 | 0.95 | 0.10 | 70 | 0.15 | 70 | 0.20 | x | x | x | x |

o: No fog occurred upon contact with fluorescent pens or felt pen or upon exposure to ethanol.
x: Fog occurred so extensively as to render the initially formed color undiscernible.

The data in Table 3 show that the samples of heat-sensitive recording paper in accordance with the present invention exhibited a higher resistance to chemicals and produced higher color densities than the comparative samples. In addition, the samples of the present invention suffered less color fading and fog under exposure to moisture and heat.

EXAMPLE 24

Two electron donating dye precursors, 3-diethylamino-6-chloro-7-anilinofluoran (10 g) and 3-(N-cyclohexyl-N-methyl)amino-6-methyl-7-anilinofluoran (10 g), were mixed with 100 g of a 5% aqueous solution of polyvinyl alcohol (degree of saponification: 98%, degree of polymerization: 500) for 24 hours in a 300 ml ball bill so as to prepare Dispersion O. In a similar manner, 1,4-bis(p-hydroxycumyl)benzene (10 g) and benzyl naphthyl ether (10 g) were mixed with 100 g of a 5% aqueous polyvinyl alcohol solution for 24 hours in a 300 ml ball mill so as to prepare Dispersion P. Twenty grams of 1,3-tris(2-methyl-4-hydroxy-5-tert-butylphenyl)butane was mixed with 100 g of a 5% aqueous polyvinyl alcohol solution for 24 hours in a 300 ml ball mill so as to prepare Dispersion Q.

Dispersions O, P, and Q were mixed in a weight ratio of 5/20/2, and to 300 g of the resulting mixture, 100 g of a 40% dispersion of calcium carbonate and 45 g of a 21% dispersion of zinc stearate were added, followed by thorough agitation to obtain a coating solution for heat-sensitive recording layer.

This solution was applied to a paper base (basis weight: 50 g/m$^2$) with a wire bar so as to form a coating having a dry weight of 6 g/m$^2$. The web was subsequently dried to provide a sample of the heat-sensitive recording material in accordance with the present invention.

EXAMPLE 25

A sample of heat-sensitive recording paper was prepared as in Example 24, except that Dispersion Q was obtained by replacing 1,1,3-tris(2-methyl-4-hydroxy-5-tert-butylphenyl)butane with 20 g of 2,2'-methylenebis(6-tert-butyl-4-methylphenol).

EXAMPLE 26

A sample of heat-sensitive recording paper was prepared as in Example 24, except that Dispersion Q was obtained by replacing 1,1,3-tris(2-methyl-4-hydroxy-5-tert-butylphenyl)butane with 20 g of 4,4'-butylidenebis(6-tert-butyl-3-methylphenol).

COMPARATIVE EXAMPLE 17

A sample of heat-sensitive recording paper was prepared as in Example 24, except that Dispersions O and P were mixed in a weight ratio of 5/20 and 300 g of the mixture was thoroughly agitated after addition of 100 g of a 40% dispersion of calcium carbonate and 35 g of a 21% dispersion of zinc stearate.

COMPARATIVE EXAMPLE 18

A sample of heat-sensitive recording paper was prepared as in Example 24, except that Dispersion P was obtained by replacing 1,4-bis(p-hydroxycumyl)benzene with 10 g of 2,2-bis(p-hydroxyphenyl)propane.

COMPARATIVE EXAMPLE 19

A sample of heat-sensitive recording paper was prepared as in Example 24, except that Dispersion P was obtained by replacing 1,4-bis(p-hydroxycumyl)benzene with 10 g of benzyl p-hydroxybenzoate.

COMPARATIVE TESTS

The samples of heat-sensitive recording paper prepared in Examples 24 to 26 and those prepared in Comparative Examples 17 to 19 were subjected to the following tests in order to compare their capabilities.

(1) Fog and Color Forming Ability:
Same as described above.

(2) Moisture Resistance:
Same as described above.

(3) Heat Resistance:
Same as described above.

(4) Resistance to Chemicals:
The chemical resistance of each of the samples was tested with two fluorescent pens (Fluorescent pen 2 of Zebra K.K. and Fluorescent Spot-Writer of the Pilot Pen Co., Ltd.), a felt pen and ethanol. The rating of the test results was conducted on a three-score basis: o (no fog occurred upon contact with the fluorescent pens, felt pen or ethanol), Δ (fog occurred but the initially formed color was discernible) and x (fog occurred and the initially formed color was no longer discernible).

The results of tests (1) to (4) are summarized in Table 4.

TABLE 4

| | Density | | Moisture Resistance | | Heat Resistance | | Fluorescent Pen | | | |
|---|---|---|---|---|---|---|---|---|---|---|
| Ex. No. | Colored Area | Fog | Percent Residual Density | Fog | Percent Residual Density | Fog | Zebra | Pilot | Felt Pen | Ethanol |
| Example 24 | 1.08 | 0.07 | 100 | 0.08 | 95 | 0.07 | o | o | o | o |
| Example 25 | 1.10 | 0.07 | 98 | 0.08 | 98 | 0.08 | o | o | o | o |
| Example 26 | 1.08 | 0.07 | 98 | 0.08 | 100 | 0.07 | o | o | o | o |
| Comparative Example 17 | 1.05 | 0.07 | 75 | 0.15 | 60 | 0.25 | o | o | o | o |
| Comparative Example 18 | 1.10 | 0.10 | 100 | 0.15 | 93 | 0.20 | x | x | x | x |
| Comparative Example 19 | 1.10 | 0.08 | 90 | 0.09 | 92 | 0.20 | x | x | x | x |

Table 4 shows that the samples of heat-sensitive recording paper in accordance with the present invention experienced less color fading under moisture or heat then the comparative samples. In addition, the samples of the present invention were more resistant to fog and chemicals.

While the invention has been described in detail and with reference to specific embodiments thereof, it will be apparent to one skilled in the art that various changes and modifications can be made therein without departing from the spirit and scope thereof.

What is claimed is:

1. A heat-sensitive recording material comprising a support and a heat-sensitive color forming layer containing a colorless or pale colored electron donating dye precursor and an electron accepting compound that reacts with said dye precursor to develop color, wherein said electron accepting compound is a bishydroxycumylbenzene or bishydroxy-α-methylbenzylbenzene compound.

2. A heat-sensitive recording material according to claim 1, wherein said colorless or pale colored electron donating dye precursor is a compound represented by formula (V)

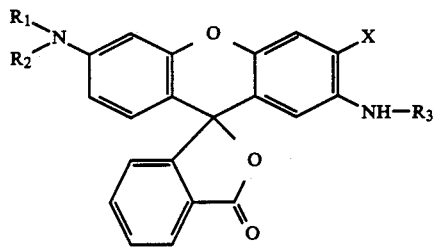

(V)

wherein $R_1$ and $R_2$ each represents an alkyl group or cycloalkyl group having from 1 to 10 carbon atoms; $R_3$ represents an aryl group; X represents an alkyl group having from 1 to 10 carbon atoms or a halogen atom.

3. A heat-sensitive recording material according to claim 2, wherein said colorless or pale colored electron donating dye precursor is a compound represented by formula (VI)

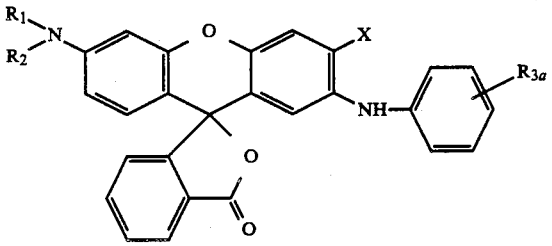

(VI)

wherein $R_1$ and $R_2$ each represents an alkyl group having from 1 to 10 carbon atoms, or $R_1$ and $R_2$ combine to form an aliphatic carbocyclic ring; $R_{3a}$ represents a hydrogen atom or an alkyl group having from 1 to 8 carbon atoms; and X represents an alkyl group having from 1 to 8 carbon atoms or a chlorine atom.

4. A heat-sensitive recording material according to claim 1, wherein said heat-sensitive color forming layer contains at least one of the heat-fusible compounds represented by formulae (VII) to (XII)

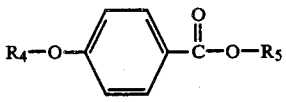

(VII)

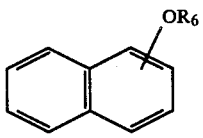

(VIII)

-continued

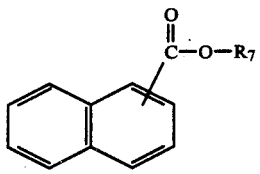

(IX)

$R_8NHCONH_2$ (X)

$R_9CONH—R_{10}$ (XI)

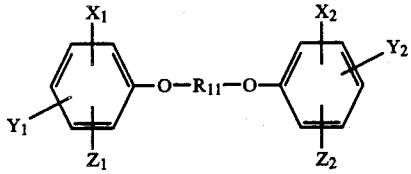

(XII)

wherein $R_4$, $R_5$, $R_6$, and $R_7$ each represents a phenyl group, a benzyl group, or a phenyl or benzyl group substituted by a lower alkyl group or a halogen atom; $R_8$ and $R_9$ each represents an alkyl group having from 12 to 24 carbon atoms; $R_{10}$ represents a hydrogen atom or a phenyl group; and $R_{11}$ represents a divalent group; $X_1$, $Y_1$, $Z_1$, $X_2$, $Y_2$ and $Z_2$ each represents a hydrogen atom, an alkyl group, a lower alkoxy group, a lower aralkyl group, a halogen atom, an alkyloxycarbonyl group, or an aralkyloxycarbonyl group.

5. A heat-sensitive recording material according to claim 4, wherein the heat-fusible compounds represented by formulae (VII) to (XII) have melting points in a range of from 70° to 150° C.

6. A heat-sensitive recording material according to claim 4, wherein the heat-fusible compounds of formulae (VII) to (XII) are used in an amount of from 10 to 200 wt% based on the weight of the electron accepting compound.

7. A heat-sensitive recording material according to claim 1, wherein said heat-sensitive color forming layer contains at least one of the phenolic compounds represented by formulae (XIII) to (XVI)

(XIII)

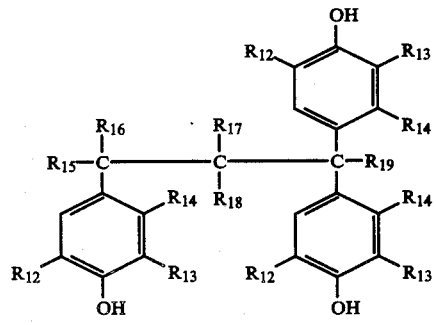

(XIV)

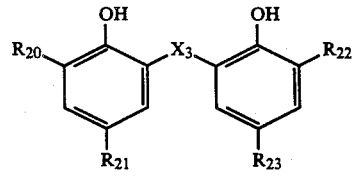

-continued (XV)

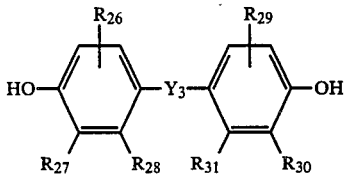

(XVI)

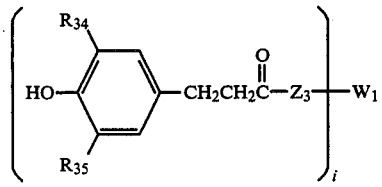

wherein $R_{12}$ represents a branched alkyl group having from 3 to 8 carbon atoms; $R_{13}$ represents a hydrogen atom or a branched alkyl group having from 3 to 8 carbon atoms; $R_{14}$ represents a hydrogen atom or an alkyl group having from 1 to 3 carbon atoms; $R_{15}$ represents a hydrogen atom or an alkyl group having from 1 to 8 carbon atoms; $R_{16}$, $R_{17}$ and $R_{18}$ each represents a hydrogen atom or an alkyl group having from 1 to 3 carbon atoms; $R_{19}$ represents a hydrogen atom or an alkyl group having from 1 to 8 carbon atoms;

$R_{20}$ and $R_{22}$ each represents a branched alkyl group having from 3 to 8 carbon atoms; $R_{21}$ and $R_{23}$ each represents an alkyl group having from 1 to 8 carbon atoms; $X_3$ represents S, O, $SO_2$, $S_2$,

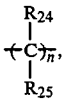

a cyclopentylene group, or a cyclohexylene group, wherein n is an integer of 0 to 3, and $R_{24}$ and $R_{25}$ each represents an alkyl group having from 1 to 8 carbon atoms;

$R_{26}$ and $R_{29}$ each represents a branched alkyl group having from 3 to 8 carbon atoms; $R_{27}$, $R_{28}$, $R_{30}$ and $R_{31}$ each represents a hydrogen atom or an alkyl group having from 1 to 8 carbon atoms; $Y_3$ represents S, O, $SO_2$, $S_2$, or

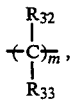

wherein m is an integer of 0 to 3, and $R_{32}$ and $R_{33}$ each represents a hydrogen atom or an alkyl group having from 1 to 8 carbon atoms, or $R_{32}$ and $R_{33}$ combine to form a cyclic pentamethylene group; and $R_{34}$ and $R_{35}$ each represents a branched alkyl group having from 3 to 8 carbon atoms; $Z_3$ represents —NH— or —O($CH_2$)n—, wherein n is an integer of from 1 to 5; i is an integer of 1 to 4, provided that if i=1, $W_1$ is an alkyl group having from 1 to 18 carbon atoms, if i=2, $W_1$ is S, O, or

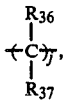

wherein $R_{36}$ and $R_{37}$ each represents a hydrogen atom or an alkyl group having from 1 to 8 carbon atoms, and j is an integer of from 0 to 8; if i=3, $W_1$ is

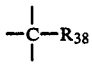

wherein $R_{38}$ is a hydrogen atom or an alkyl group having from 1 to 8 carbon atoms; and if i=4, $W_1$ is

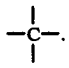

8. A heat-sensitive recording material according to claim 7, wherein the amount of phenolic compounds repesented by formulae (XIII) to (XVI) is from 5 to 200 wt% based on the weight of the electron accepting compound.

9. A heat-sensitive recording material according to claim 1, wherein said heat-sensitive color forming layer contains at least one of the compounds represented by formulae (XVII) to (XXI)

(XVII)

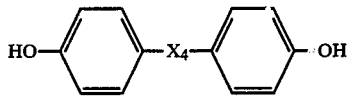

(XVIII)

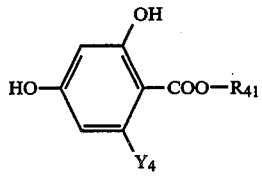

(XIX)

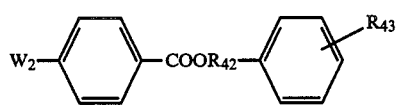

(XX)

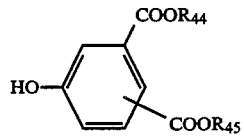

(XIX)

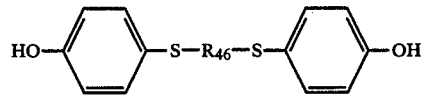

wherein $X_4$ represents S, O, $SO_2$, $S_2$ or

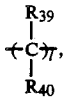

wherein l is an integer of 0 to 3; $R_{39}$ and $R_{40}$ each represents a hydrogen atom or an alkyl group having from 1 to 8 carbon atoms, or $R_{39}$ and $R_{40}$ combine to form a cycloalkyl group;

$Y_4$ represents a hydrogen atom, $—CH_3$, or —OH;

$R_{41}$ represents

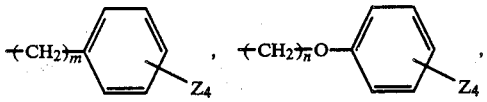

or a straight chain or branched chain alkyl group having from 1 to 6 carbon atoms, wherein m and n are each an integer of 0 to 3, and $Z_4$ represents a hydrogen atom, a halogen atom, or $—CH_3$;

$W_2$ represents a hydrogen atom or —OH; $R_{42}$ represents a straight chain or branched chain alkylene group having from 1 to 8 carbon atoms; $R_{43}$ represents a hydrogen atom, a halogen atom or an alkyl group having from 1 to 8 carbon atoms;

$R_{44}$ and $R_{45}$ each represents an alkyl group having from 1 to 8 carbon atoms; and $R_{46}$ represents an alkylene group having from 1 to 5 ether linkages.

10. A heat-sensitive recording material according to claim 9, wherein the compounds of formulae (XVII) to (XXI) are present in an amount of from 5 to 200 wt% based on the weight of the electron accepting compound.

11. A heat-sensitive recording material according to claim 1, wherein said electron accepting compound is at least one compound selected from the group consisting of 1,3-bis-p-hydroxycumylbenzene and 1,4-bis-p-hydroxycumylbenzene.

* * * * *